US011129434B2

(12) United States Patent
Opalacz et al.

(10) Patent No.: US 11,129,434 B2
(45) Date of Patent: Sep. 28, 2021

(54) Y-STRAP SPORT SANDAL

(71) Applicants: Daniel Opalacz, El Sobrante, CA (US); Nicholas Pence, El Sobrante, CA (US)

(72) Inventors: Daniel Opalacz, El Sobrante, CA (US); Nicholas Pence, El Sobrante, CA (US)

( * ) Notice: Subject to any disclaimer, the term of this patent is extended or adjusted under 35 U.S.C. 154(b) by 239 days.

(21) Appl. No.: 16/503,400

(22) Filed: Jul. 3, 2019

(65) Prior Publication Data

US 2019/0320755 A1 Oct. 24, 2019

Related U.S. Application Data

(63) Continuation-in-part of application No. 15/587,499, filed on May 5, 2017.

(60) Provisional application No. 62/696,972, filed on Jul. 12, 2018, provisional application No. 62/334,973, filed on May 11, 2016.

(51) Int. Cl.
*A43B 3/12* (2006.01)
*A43C 11/14* (2006.01)

(52) U.S. Cl.
CPC ..... *A43B 3/122* (2013.01); *A43B 3/126* (2013.01); *A43B 3/128* (2013.01); *A43C 11/14* (2013.01)

(58) Field of Classification Search
CPC ..... A43B 3/103; A43B 3/105; A43B 3/12; A43B 3/122; A43B 3/126; A43C 11/14; A43C 11/1493
See application file for complete search history.

(56) References Cited

U.S. PATENT DOCUMENTS

| | | | | |
|---|---|---|---|---|
| 2,193,943 | A | 3/1940 | Shea | |
| 3,978,596 | A * | 9/1976 | Brown | A43B 3/122 36/11.5 |
| 4,793,075 | A | 12/1988 | Thatcher | |
| 4,869,000 | A | 9/1989 | York | |
| 5,205,054 | A | 4/1993 | York | |
| 5,228,216 | A | 7/1993 | Sargent | |
| 5,659,978 | A | 8/1997 | Bell | |
| 6,086,451 | A | 7/2000 | Fernandes | |
| 6,237,250 | B1 | 5/2001 | Aguerre | |
| D495,855 | S | 9/2004 | Comeau | |
| 6,968,634 | B2 | 11/2005 | Dombowsky | |
| 7,121,020 | B1 | 10/2006 | Bathum | |
| 7,222,440 | B2 | 5/2007 | Dombowsky | |
| 7,819,721 | B1 | 10/2010 | Messier | |
| 8,250,780 | B1 | 8/2012 | Diaz | |
| 8,381,415 | B1 | 2/2013 | Lanoue | |

(Continued)

OTHER PUBLICATIONS

Jarvis, Shamma, Sandals Mountain Goats Review, Barefoot Shoes, Sep. 25, 2014, downloaded from https://birthdayshoes.com/shamma-sandals-mountain-goats-review on May 4, 2017.

(Continued)

*Primary Examiner* — Sharon M Prange
(74) *Attorney, Agent, or Firm* — Richard A. Baker, Jr.

(57) ABSTRACT

A huarache sport sandal with a unique strap systems is described. The sandal strap includes a G-hook and G-Hook strap system to facilitate the comfortable adjustment of the sandal on a foot. Additional adjustments in the strap systems include a ladder buckle and a hook and loop adjustment system. The strap system is attached to a hard rubber sole to keep the sole comfortable connected to the foot during sports activities.

9 Claims, 7 Drawing Sheets

(56) References Cited

U.S. PATENT DOCUMENTS

| | | | | |
|---|---|---|---|---|
| 8,523,629 | B2 | 9/2013 | Pundyk | |
| 9,510,638 | B2 | 12/2016 | McDonald et al. | |
| 2006/0059720 | A1* | 3/2006 | Phelan | A43B 3/242 36/101 |
| 2006/0288610 | A1 | 12/2006 | Laska | |
| 2009/0313854 | A1 | 12/2009 | Clarke | |
| 2012/0302135 | A1 | 11/2012 | Solotoff | |
| 2013/0160326 | A1* | 6/2013 | Szekeresh | A43B 7/32 36/102 |
| 2013/0318829 | A1* | 12/2013 | Opalacz | A43B 5/00 36/114 |
| 2014/0075783 | A1* | 3/2014 | Licht | A43B 1/0081 36/101 |
| 2015/0027004 | A1 | 1/2015 | Conrad et al. | |
| 2015/0237950 | A1 | 8/2015 | Caldwell | |
| 2016/0113350 | A1 | 4/2016 | Sashen | |
| 2017/0027241 | A1 | 2/2017 | Solotoff | |
| 2017/0273379 | A1 | 9/2017 | Kyle | |

OTHER PUBLICATIONS

Unshoes, Introducing the Keota Sandal!, Oct. 28, 2015, downloaded from https://unshoes.wordpress.com/2015/10/28/introducing-the-keota-sandal/ on May 4, 2017.

* cited by examiner

Y-STRAP SPORT SANDAL

CROSS REFERENCE

This patent application is a continuation in part to pending U.S. patent application Ser. No. 15/587,499, "Huarache Sport Sandal", filed by the inventors on May 5, 2017. U.S. patent application claims priority to U.S. Provisional Patent application 62/334,973, "Huarache Sport Sandal", filed by the inventors on May 5, 2016. This present patent application also claims priority to U.S. Provisional Patent Application 62/696,972, "Huarache Sport Sandal", filed by the inventors on Jul. 12, 2018. These three patent applications included herein by reference.

FIELD OF THE INVENTION

The present invention relates generally to the field of footwear. More specifically, the present invention is a rugged, yet minimally soled, outdoor-sandal created for trail, river, and all around outdoor usage.

BACKGROUND OF THE INVENTION

The present invention creates solutions to solve a number of problems related to the technical outdoor huarache sport sandal. These solutions relate to durability, fit, and strap adjustability of the outdoor sandal.

SUMMARY OF THE INVENTION

A huarache sport sandal is made up of a sole with one sole hole near a toe of the sole, an interior sole wing situated near a heel of the sole, and an exterior sole wing on an opposite side of the sole from the interior sole wing, near the heel of the sole, where the interior sole wing and the exterior sole wing consist of webbing strap and rubber that extend above the sole. The exterior sole wing of the sandal includes a mechanical ring connected on a heel side of the exterior sole wing. The first end of a toe lacing is fixed at the sole hole, the toe lacing forming a loop for connection to a toe strap, and returning to and fixed at the sole hole as a second end of the toe lacing. The toe strap of the sandal is connected to a paracord loop at one end and to the toe lacing loop on the other. A wing hook strap is affixed to the interior sole wing on one end and to the paracord loop on a second end, wherein the wing hook strap includes a G-hook that hooks into one of a plurality of hook pockets. A connector hook strap of the sandal is connected to the paracord loop on one end and to a mechanical connection device on another end. A wing connection strap is connected through the mechanical connection device on one end and to the exterior sole wing on the other. And a heel strap of the sandal is connected to the interior sole wing on one end and to the exterior sole wing on the second end through the mechanical ring, said heel strap including a hook and loop fastener system or a G-Hook system to connect to itself after passing through the mechanical ring.

The mechanical connection device described above could be ladder lock buckle. The wing hook strap could be made up of two straps sewn together. The two straps could be sewn laterally to form the plurality of hook pockets. The sole could be made of leather, rubber or other materials. The paracord loop could be made of metal, paracord, or other materials. The toe strap could be made of nylon or other materials.

A method for wearing a huarache sport sandal made up of the steps of placing a foot into the sandal, the bottom of the foot resting on the sole, where the sole includes an interior wing and an exterior wing, both wings connected to the sole and extending above the sole, the wings connected together by an adjustable heel strap. Pulling the adjustable heel strap tight against a hindfoot of the foot to hold the foot into the sandal and connecting the adjustable heel strap with a hook and loop fabric or with a G-hook and G-hook strap. Moving a G-hook to one of a plurality of hook pockets on a wing hook strap, the G-hook strap connected to the interior wing and to a paracord ring, and adjusting a mechanical connection on a wing connection strap, the wing connection strap connected between the exterior wing and the paracord ring.

The mechanical connection in the above method could be a ladder lock buckle. The adjustment could involve pulling a strap looped through the ladder lock buckle or pulling up on the ladder lock buckle to allow the strap to loosen. The paracord loop could be connected to a toe strap that is further connected to the sole.

An apparatus for wearing on a foot that is made up of a a sole of the apparatus, the sole including an interior wing and an exterior wing, a G-hook, and a hook strap made of strapping connected to the interior wing and the exterior wing, the strapping including a plurality of pockets for receiving the G-hook, where moving the G-hook to a different pocket adjusts a fit of the apparatus on the foot. The G-hook could be attached to an end of the hook strap. The hook strap could be looped through a ring. The apparatus could be a sandal. The pockets could be formed by stitching in a second piece of strapping on top of the hook strap. The G-hook could be made of plastic.

DETAIL DESCRIPTIONS OF THE INVENTION

All illustrations of the drawings are for the purpose of describing selected versions of the present invention and are not intended to limit the scope of the present invention.

STRAP SYSTEM OVERVIEW

The sandal described herein maintains the huarache strap aesthetic of the sandal strap design as described in U.S. Patent Publication 2013/0318829, hereby incorporated by reference, while dramatically improving upon its functionality, adjustability, and durability. The current sandal design articulates the different segments of the huarache sandal strap (i.e. thong strap) into non continuous adjustment zones. The new sandal strap system makes adjustment of one strap completely independent of one another on the sandal (i.e. changing the tightness of the heel strap does not affect the orientation of the thong strap as it does in a classic continuous lace huarache sandal design). Making these three adjustment zones independent of one another dramatically increases the range and ease of adjustability on the sandal.

In the following description, the strapping described could be made of nylon, polyester, leather, rubber, plastic, cotton, elastic, or other materials. Similarly, the lacing could be made of paracord, nylon, polyester, leather, rubber, plastic, cotton, elastic, or other materials. The paracord loop, while made of paracord in the preferred embodiment, could be made of steel, aluminum, brass, other metals, plastic, polyester, nylon, leather, cotton, or other materials.

Figure 1:
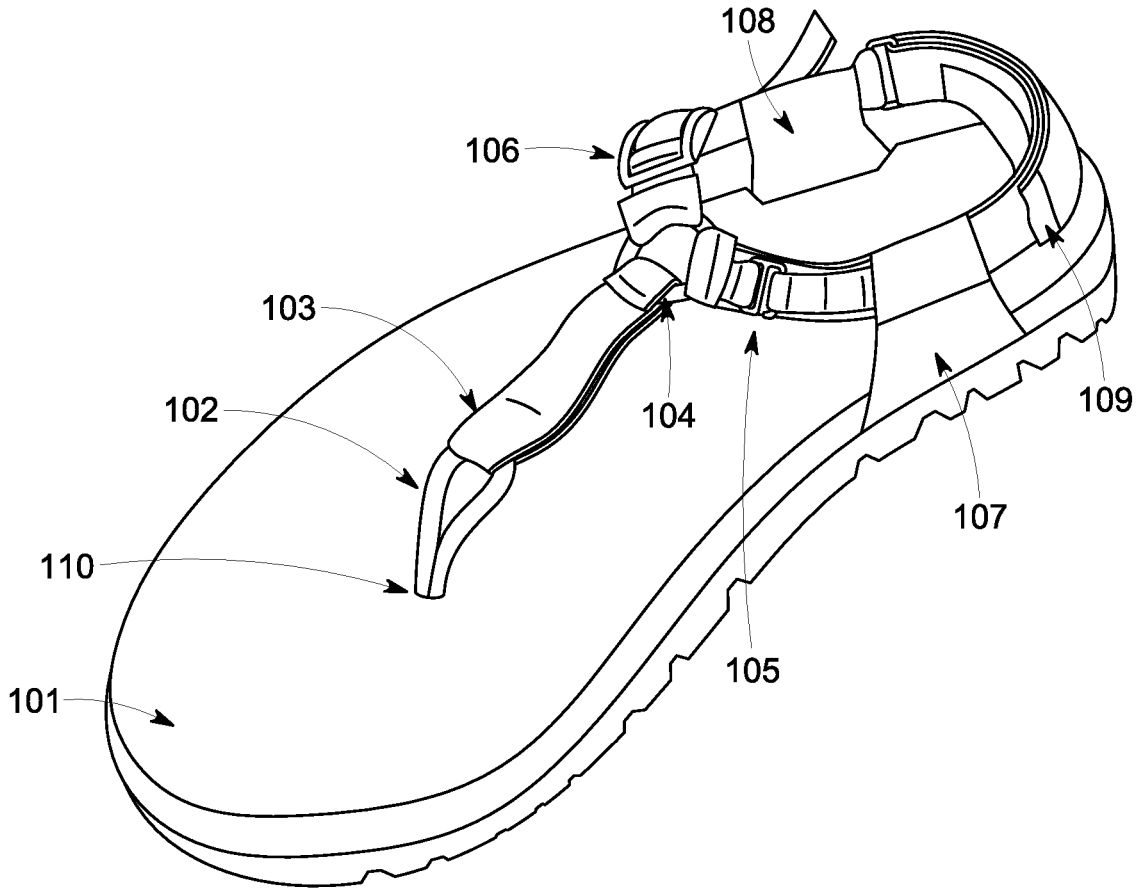
FIG. 1 is a perspective view illustration of the sandal with the sandal strap design.
Figure 2:
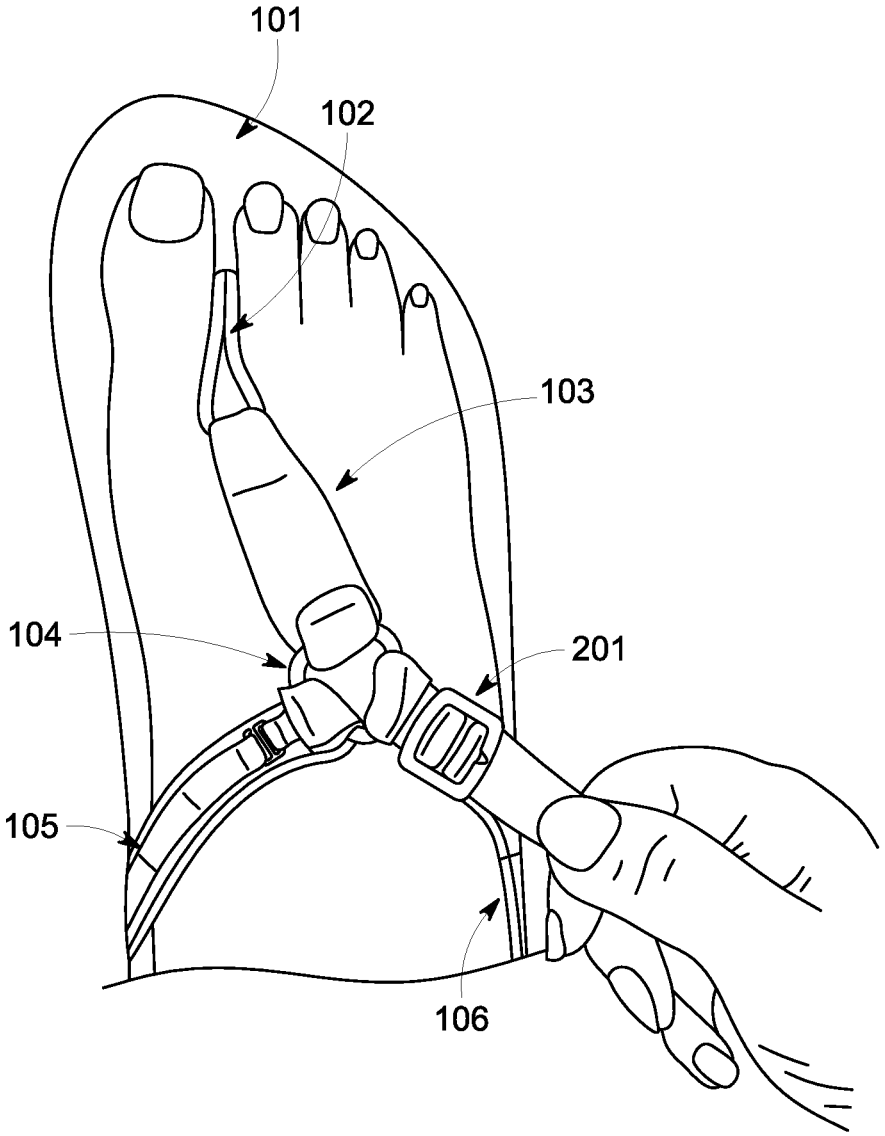
FIG. 2 is a top view illustration of the front three straps of the sandal.

The present sandal design contains four main webbing strap segments. The front three straps (thong strap 103, hook strap 105, and ladder lock buckle strap 106), as can be seen in FIG. 1 and FIG. 2, are all connected at the top of the foot by a soft and strong nylon paracord loop 104. The soft nylon loop 104 makes for a comfortable strap connection point that does not hurt the wearer's feet. The ladder lock buckle strap 106 is located on the outside of the wearer's feet for ease of use and comfort. The hook strap 105 is located on the inside of the wearer's foot. The fourth strap is the heel strap 109 and adjusts with a hook and loop fabric (such as Velcro®) through a metal loop hardware 301 in the preferred embodiment. The loop hardware 301 could also be made of plastic, paracord, or other materials.

The sandal strap system has 3 points anchored into the custom sole 101. In the preferred embodiment, the sole is made of hard rubber, such as Regolith™ Vibram® soles.

However, the sole could be made of leather, plastic, wood, polyurethane (PU), TPR (thermoplastic rubber, combination of polyurethane and rubber), TPU (thermoplastic polyurethane), TR/TPR, EVA (ethyl vinyl acetate), EVA/RUBBER, nitro polyvinyl chloride, or other materials.

The bottom of the sole 101 has a pattern for providing traction when walking or running. The first anchor point 110 in the sole 101 is through a sturdy thong strap corded toe lacing 102 plug design. The plug is countersunk into the sole 101 to avoid heavy wear. (In another embodiment, the thong strap attaches to strapping glued between the midsole and the outsole.) The second and third anchor points are located on the interior 107 and exterior 108 sides of the sole 101 by the wearer's ankle. The hard rubber of the sole 101 extends upwards above the rest of the sole 101 on either side of the ankle to form an interior wing 107 and an exterior wing 108. These wings 107, 108 connect to the heel strap 109, the hook strap 105 and the buckle strap 106.

In one embodiment, the sole 101 consists of two pieces, a midsole and an outsole, glued together. The wings 107, 108 are part of the mold for the outsole piece. The midsole has a molded pattern and is glued in between the wings 107, 108. On the inside of the wings 107, 108, webbing is sewn to the hard rubber wings. The webbing runs from the interior wing 107 between the two pieces of the sole 101 in a channel to the exterior wing 108, where it is again sewn. The webbing extends above the wings 107, 108 on both sides, and connects to the heel strap 109, the hook strap 105 and the buckle strap 106. This webbing could be a single piece of webbing that runs through a cutout channel in the midsole, providing a connection for the webbing on the interior wing 107 and the exterior wing 108. The midsole channel prevents an uneven surface on the foot side of the midsole.

The sole 101 could be molded such that the midsole has an ergonomic shape on the sole 101 footbed to provide comfort to the user.

ADJUSTMENT MECHANISMS AND FEATURES

HEEL STRAP

Figure 3:
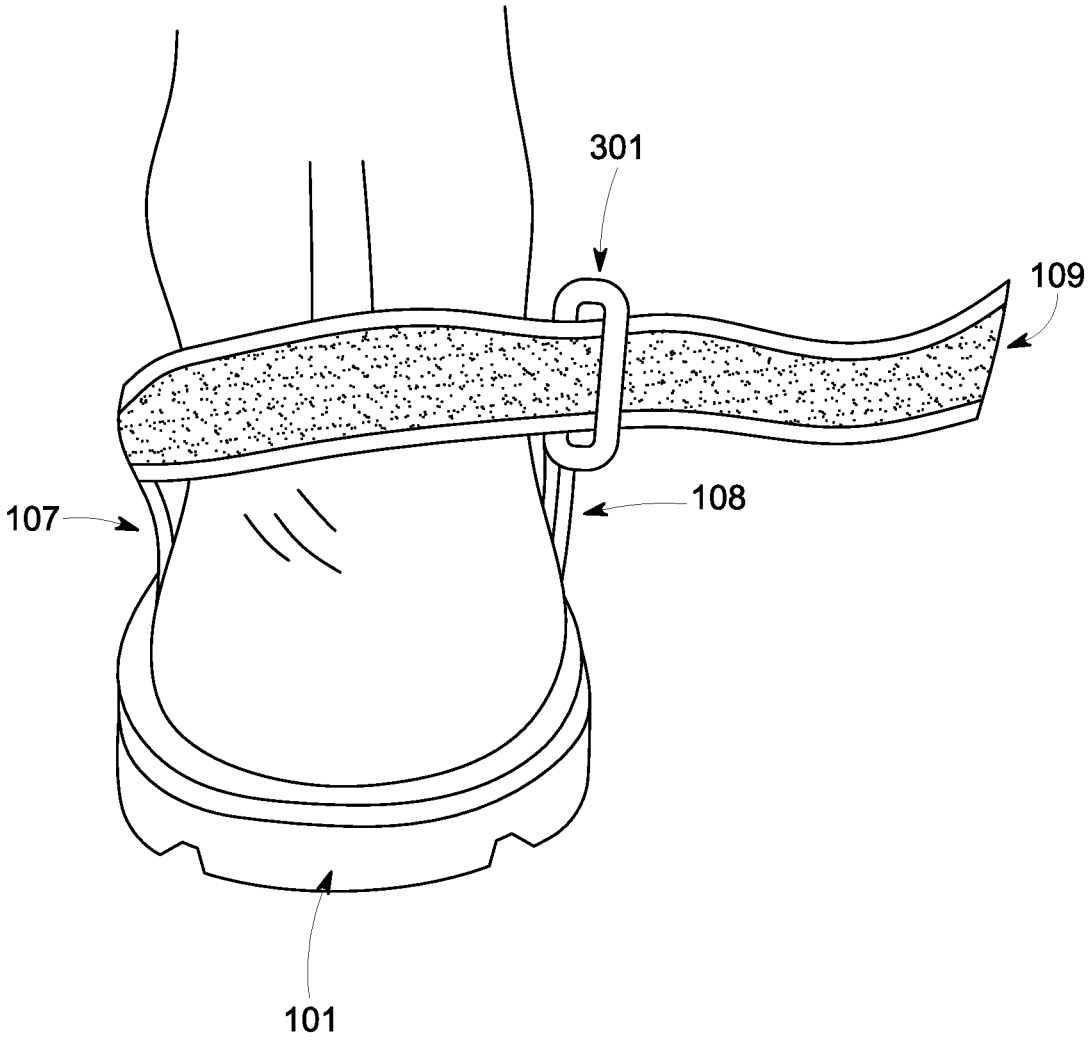
FIG. 3 is a rear view illustration of the heel strap.

As seen in FIG. 3, the heel strap 109 begins at the interior wing anchor point 107. The heel strap 109 is sewn together with polyester webbing on the outside and a loop and hook fabric (such as Velcro®) on the inside. The heel strap is sewn to the interior wing 107 and wraps behind the heel, then through a metal loop 301 connected to the exterior wing anchor point 108. The heel strap 109 loop portion of the hook and loop fabric is facing away from the heel as the heel strap 109 threads through the mechanical ring 301, and the end of the heel strap 109 beyond the ring has the hook portion of the hook and loop fabric. The heel strap 109 folds through the mechanical ring 301 back on itself, adhering using the hook and loop fabric (Velcro®). The heel strap 109 gives quick and intuitive adjustment to tighten or loosen the sandal tightness at the hindfoot (the back of the foot above the heel). Note that Velcro® is a mechanical fabric hook and loop fastening system.

LADDER LOCK BUCKLE STRAP ADJUSTMENT

The ladder-lock buckle strap adjustment 201 is located on the outside of the foot. The buckle strap 106 is anchored to both the paracord loop 104 at one end and the exterior wing anchor point 108 at the other end. The buckle strap 106 is actually two pieces of webbing, one sewn in a loop around the paracord loop 104 at one end and the other sewn in a loop around the ladder lock buckle 201. The second piece of webbing is sewn to the exterior wing 108 at one end and loops through the ladder lock buckle 201 at the other end, allowing the user to pull the strap 106 to shorten the length, thereby tightening the sandal. The buckle strap 106 adjusts tightness through a ladder lock buckle 201. The ladder lock buckle 201 could be made of Acetal Plastic in the preferred embodiment, but could also be made of metal or other materials. Tugging the tag end of webbing 106 through the buckle 201 tightens the system. This adjusting mechanism is simple to use and is used as an everyday-adjuster for tightening, loosening, putting the sandals on, and taking them off

HOOK STRAP

Figure 4:
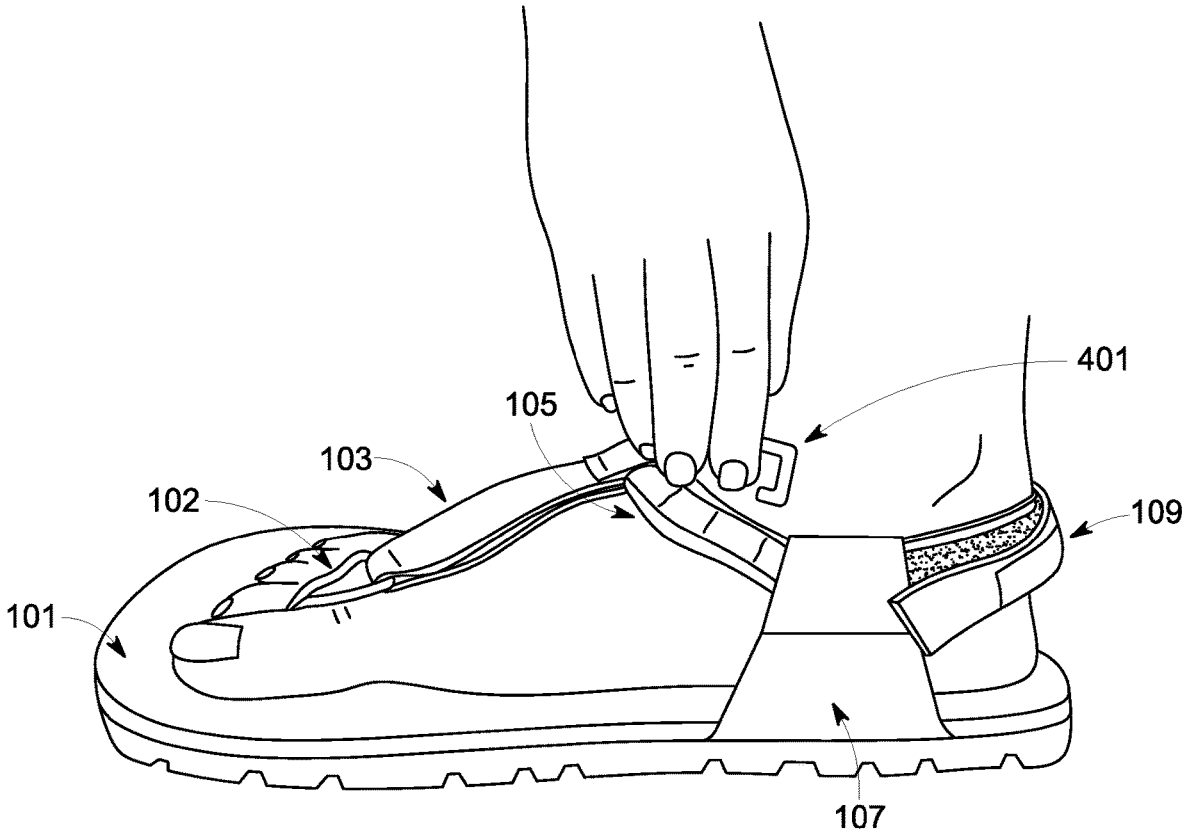
FIG. 4 is an interior side view illustration of the sandal and straps.
Figure 5:
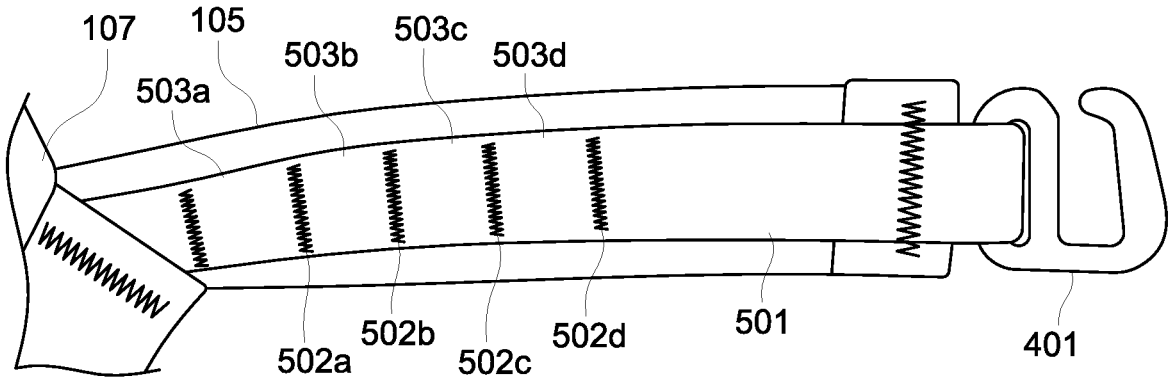
FIG. 5 is a detailed view of the hook strap 105 pulled through the paracord loop 104 with the G-Hook 401.

As seen in FIG. 4 and FIG. 5, the hook strap 105 serves as an extremely useful mechanism for customizing the fit of the sandal for each wearer's preferences during both casual and intense activities. The hook strap 105 tighten or expands the overall volume of the strap system and controls the angle at which the thong strap 103 strikes the top of the wearer's foot. It is critical to be able to adjust the angle of the thong strap 103 on a huarache sandal for ideal comfort through various activities and for various foot sizes. The hook strap 105 creates an ideal mechanism for this adjustment process as it is very flexible, comfortable, durable, and strong. Unlike a hook and loop fabric (Velcro®) adjuster in this area, the hook strap 105 will not come undone during water activities like swimming, and cliff jumping.

The hook strap 105 could be composed of a custom molded plastic ½" G-hook 401, two different widths of webbing 105, 501, and a series of bartack stitches 502*a-d*. The narrower ½" webbing 501 is sewn into the wider ¾" polyester tubular webbing 105 at consistent intervals. In between each of these bartacks 502*a-d* leaves a ½" long gap (hook pocket) 503*a-d* between the ½" and ¾" straps for the aluminum G-hook 401 to fit in. The G-Hook 401 is sewn to the end of flat ½41 webbing 501 and is the terminating point of the hook strap 105. The G-Hook could also be made of different sizes and of aluminum, other metals, or similar materials.

The non-hook end of the Bedrock Hook strap 105 is sewn into the front end of interior wing anchor point 107. The Hook Strap 105 is then looped through the paracord loop 104 back on itself. The G-Hook 401 then has 3-5 different ½" long hook pockets 503*a-d* between the ½" webbing 501 and ¾" webbing 105 to hook into. This range gives the wearer the ability to tighten or loosen the hook strap 105 and thus change the orientation of the thong strap 103. Of course, the size of the strapping here and throughout this document could be varied without deviating from the design.

SOLE WINGS

The sole wings 107, 108 provide wearers with more lateral stability and comfort compared to a traditional huarache single thru-sole strap design. The wings 107, 108 provide two strong and durable anchor points for the strap system to connect to on either side of the wearer's ankle.

The wings 107, 108 consist of both a 1.5-inch-wide webbing strap and rubber wings from the sole 101 that wrap up and above the sole footbed 101. The 1.5-inch-wide webbing runs as a continuous piece through the sole 101 in a channel between the midsole and the rubber outsole. The webbing is then folded over and sewn into the rubber wing 107, 108. This fold creates two gaps (front and back) for the Bedrock Cairn Strap System 102-106 and 109 to connect to.

CORDED TOE STRAPS

Our corded toe lacing 102 create a loop with nylon paracord that terminates in a plug in the sole anchor point 110. This corded toe lacing 102 then loops into our main thong strap 103 with another loop. This main thong strap loop 103 is strapping folding over itself, folded with a bow-tie pinch, and finally sewn together. The utility behind the corded toe lacing 102 is to create a strap that can rest comfortably between the sandal wearer's toes, provide strength to keep the wearer's feet from sliding too far forward, and create a toe lacing 102 that can be replaceable if it ever breaks or wears out.

In one embodiment, the corded toe lacing 102 is sewn into strapping with a bartack stitch, and the strapping is glued in the sole 101, between the outsole and the midsole. The midsole could have a molded cutout for receiving the strapping and corded toe lacing so that the midsole surface remains smooth against the foot. In some embodiments, the toe lacing 102 could be made of leather, strapping or other materials. In another embodiment, the thong strap 103 and the toe lacing 102 could be the same strap or lacing.

The toe straps 102, 103 create a comfortable and gradual transition between the wider thickness of the main thong strap 103 and the desired narrower thickness for comfort between the big and second toe. The corded toe lacing 102 gradually narrows from the base of its connection with the main strap and its termination in the plug. The corded toe lacing 102 is completely replaceable. Because the corded toe lacing 102 loops into the main thong strap 103 it can be easily replaced on the trail or wilderness if it ever wears out. The wearer can take a piece of paracord or rope, string it through the loop in the main thong strap 103, feed both tag ends through the thong strap hole in the sandal sole 101, and tie them together to create a knot. This knot will replace the function of the plug and will hold the strapping system in place in the thong strap 103.

G-HOOK HEEL STRAP

Figure 6:
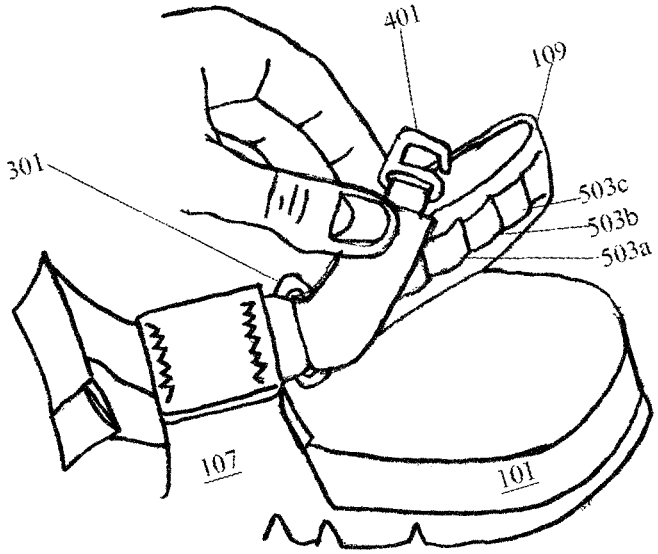
FIG. 6 is an illustration of the G hook and plurality of pockets on the heel strap.
Figure 7:
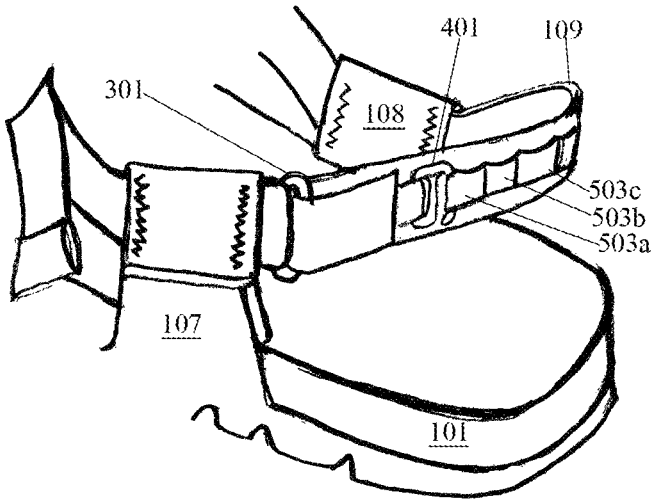
FIG. 7 is an illustration of the G hook connected to the plurality of pockets on the heel strap.

In an alternative embodiment seen in FIGS. 6 and 7, the heel strap 109 is replaced with a G-Hook system as seen in FIG. 5. For wearers engaged in water activity as well as anything highly active in the outdoors, they may prefer a heel strap 109 that is more durable and less prone to fail than hook+loop Velcro. A heel strap 109 with one continuous piece of webbing will completely eliminate any chance of hook+loop heel strap delamination (failure) in wet and muddy conditions as well as found with long term Velcro wear+tear from years of use. Although the single continuous webbing heel strap solves this durability issue, it offers no adjustment whatsoever, leaving wearers with a less than ideal fit. Typically this creates a heel strap that is not secure and snug up against the heel.

We have used our G hook technology to a design a failure-proof heel strap that is completely adjustable to fit each unique wearer perfectly. The new G-hook Heel Strap provides a customized fit that wearers seek, yet, will provide sturdy and failure proof support while swimming, submerged in water, traversing muddy terrain, and in any environment whatsoever that would traditionally pose problematic for a hook+loop closure system. The G-Hook Heel Strap also provides far more long term durability than a hook+loop alternative as there is no wear with continual adjustment use.

The G-Hook Heel Strap consists of at least two layers of webbing (webbing pile). A wider webbing (20mm) 109 touches the wearer's heel, and a narrower webbing 501 matches the width of the aluminum G hook 401 and is sewn into the wider webbing with Hook Pocket bartack stitches 502*a-c*. The webbing pile begins at the inside sole hugger wing 108, wraps around the foot and through an aluminum loop 301 (attached to the outside sole hugger wing 107), then wraps back around the foot, ending with the aluminum G hook 401 which can hook into any variety of Hook Pockets 503a-c. The further the G hook wraps back towards the inside of the foot, hooking into an available Hook Pocket, the tighter the heel strap will fit the wearer. Depending on size there may be up to 10 hook positions available for the G-hook adjuster. Once the Aluminum G Hook 401 is hooked into the Hook Pockets 503*a-c*, the G-Hook Heel Strap 109 will be fully secure for all outdoor activities.

A third layer of webbing may be sewn into the webbing pile of the G Hook heel strap 109 to provide the wearer with a cushion between the aluminum G hook hardware and the heel of their foot. The multiple layers of webbing helps create a sturdy, yet comfortable heel strap. Alternatively a thicker more plush wide webbing can be used to create this layer of comfort.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A sandal comprising:

a sole for the sandal with one sole hole near a toe of the sole, an interior sole wing situated near a heel of the sole, and an exterior sole wing on an opposite side of the sole from the interior sole wing, near the heel of the sole, wherein the interior sole wing and the exterior sole wing consist of webbing strap and rubber that extend above the sole;

the exterior sole wing including a mechanical ring connected on a heel side of the exterior sole wing;

a first end of a toe lacing fixed at the sole hole, said toe lacing forming a loop for connection to a toe strap, and returning to and fixed at the sole hole as a second end of the toe lacing;

the toe strap connected to a paracord loop at a first end of the toe strap and to the toe lacing loop on a second end of the toe strap;

a wing hook strap affixed to the interior sole wing on a first end of the wing hook strap and to the paracord loop on a second end of the wing hook strap, wherein the wing hook strap includes a first G-hook that hooks into one of a first plurality of hook pockets;

a buckle strap having:

a first portion connected to the paracord loop on a first end of the first portion and to a mechanical connection device on a second end of the first portion; and a second portion connected through the mechanical connection device on a first end of the second portion and to the exterior sole wing on a second end of the second portion; and a heel strap connected to the interior sole wing on a first end of the heel strap and to the exterior sole wing on a second end of the heel strap through the mechanical ring, said heel strap includes a second G-hook that hooks into one of a second plurality of hook pockets.

2. The sandal of claim 1 wherein the mechanical connection device is a ladder lock buckle.

3. The sandal of claim 1 wherein the wing hook strap comprises two strap pieces sewn together.

4. The sandal of claim 3 wherein the two strap pieces are sewn laterally to form the first plurality of hook pockets.

5. The sandal of claim 1 wherein the sole is made of leather.

6. The sandal of claim 1 wherein the sole is made of rubber.

7. The sandal of claim 1 wherein the paracord loop is made of metal.

8. The sandal of claim 1 wherein the paracord loop is made of leather.

9. The sandal of claim 1 wherein the toe strap is made of nylon.

* * * * *